United States Patent [19]

Petersen

[11] 4,097,089

[45] Jun. 27, 1978

[54] CHAIR ASSEMBLY FOR AN INCREMENTAL PLATING HAVING A TELESCOPING SLEEVE-LIKE CONSTRUCTION

[75] Inventor: Warren D. Petersen, St. Charles, Ill.

[73] Assignee: Burd, Inc., Howell Division, St. Charles, Ill.

[21] Appl. No.: 740,025

[22] Filed: Nov. 8, 1976

[51] Int. Cl.[2] ..... A47C 1/12

[52] U.S. Cl. ..... 297/447; 297/440; 297/445

[58] Field of Search ..... 297/440, 445, 447

[56] References Cited

U.S. PATENT DOCUMENTS 3,874,729 4/1975 Blodee ..... 297/445

FOREIGN PATENT DOCUMENTS 376,251 7/1932 United Kingdom ..... 297/440

*Primary Examiner*—James C. Mitchell

*Attorney, Agent, or Firm*—Hill, Gross, Simpson, Van Santen, Steadman, Chiara & Simpson

[57] ABSTRACT

Chair frames are formed from identical tubular frame components having tubular studs projecting laterally therefrom in a mirror image arrangement and crimped to telescope into the ends of tubular stretcher members. The crimped portions of the studs provide two abutting walls increasing the anchoring capacity for stretcher carried screw fasteners which are threaded therein to lock the stretchers to the studs. The ends of the stretchers abut the frame to cover any weld beads joining the studs to the frames. All of the tubular components are electroplated.

11 Claims, 6 Drawing Figures

Fig. 1
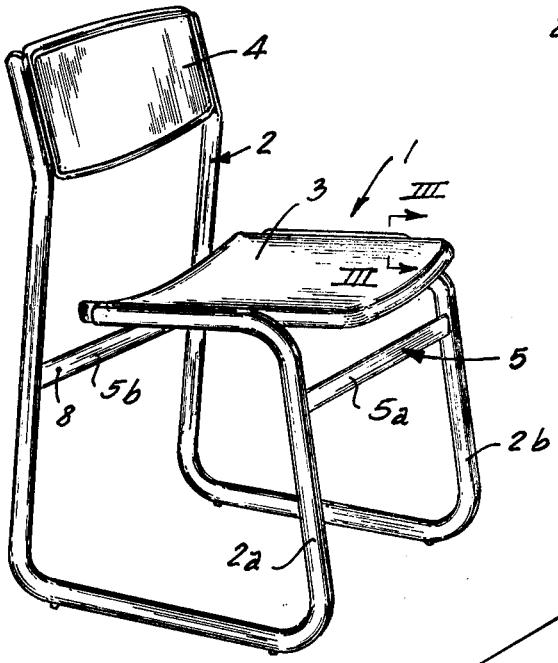
Fig. 3
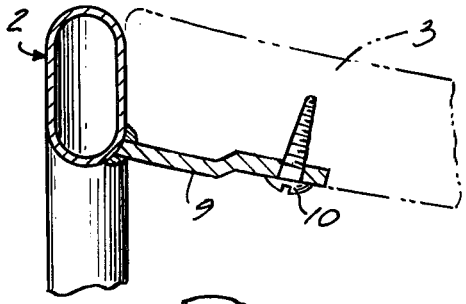
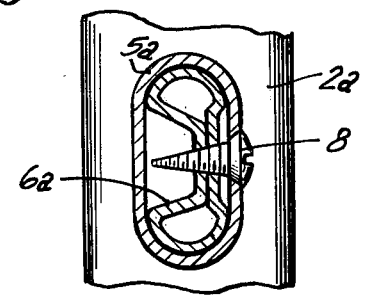
Fig. 5
Fig. 2
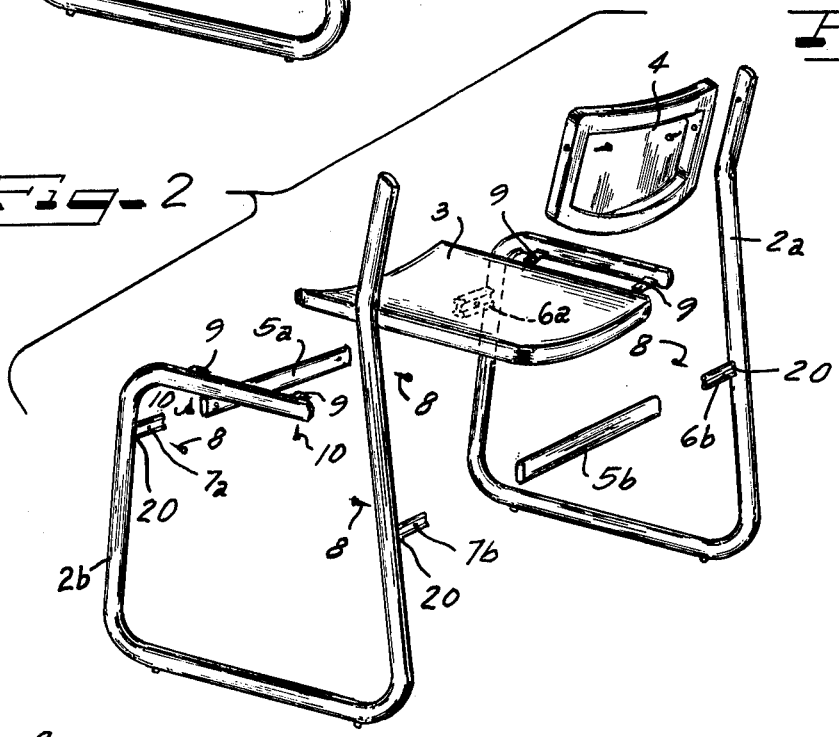
Fig. 4
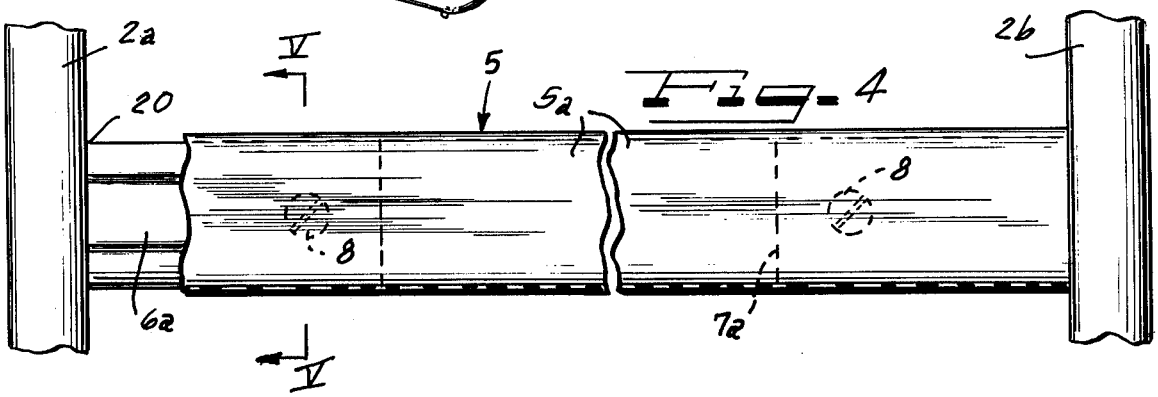

CHAIR ASSEMBLY FOR AN INCREMENTAL PLATING HAVING A TELESCOPING SLEEVE-LIKE CONSTRUCTION

BACKGROUND OF THE INVENTION

1. Field of the Invention

The invention relates to an assembly arrangement for efficient, inexpensive and easy plating of chair frame components independently. The invention further provides for easy and efficient assembly of said frame providing a stable permanent base and support for a chair. The invention is characterized by utilizing two identical frame components having welded studs affixed thereon in a mirror image fashion to receive reciprocal stretchers by telescoping engagement.

2. Prior Art

In order to plate chair frames and structures, it is generally necessary in the art to plate individually each chair support base as an assembled unit. Because of the geometry, this method requires a production line generally designated to handle individual assembled frame units. These plating techniques prove costly and inefficient since it requires individual effort to plate each frame unit separately, and the time for plating is independent of the number of units if such are treated simultaneously. However, to process a greater number of standard frame units would require a costly change in the already existing production lines.

The prior art is replete with assembled chairs, however, on careful review, it fails to teach an assembly for chairs such as and for purposes contemplated by the present invention.

Cable U.S. Pat. No. 1,950,226 issued in 1934 on a chair, generally, teaches a continuous tubular metal frame structure for a chair.

The patent, however, does not teach a tubular sleeve-like construction having a weldable insert for purposes of joining a complementary member as contemplated by the present invention. In view of such disclosure, Cable U.S. Pat. No. 1,950,226 is distinguishable and would not be considered a prior art reference.

Melder U.S. Pat. No. 1,960,022 is another very early expired patent which teaches a unitary metal tube construction bent to form a rectangular frame wherein one end of said frame is bent up vertically to form the rear support for said chair, and the opposite end of said frame being bent up vertically and horizontally to form the base and seating portions for the chair. Melder U.S. Pat. No. 1,960,022 is clearly distinguishable and not considered a prior art reference.

Generally, Kehoe U.S. Pat. No. 3,309,136 teaches a chair structure having a single standard resiliently supporting a seat and a back rest independently of one another. It provides a simplified chair structure having a single standard resiliently mounting a back rest and a seat for limited resiliently resisted movement and including arm rest mounted for movement with the seat and for limited resiliently resisted movement with respect to said seat. The resilient base structure does not comprise a tubular sleeve-like construction having an insert for joining complementary members as contemplated by the present invention, and in view of such would not be considered a prior art reference.

Gibilterra U.S. Pat. No. 3,815,955 teaches a chair comprising a pair of spaced, flexible side frames wherein each of said frames is formed from a single elongated member and includes a back supporting portion adjacent one end of the elongated member, a rear leg portion connected to the back supporting portion and extending downwardly therefrom, a base portion connected to the rear leg portion and extending forwardly substantially horizontally therefrom, and a front leg portion connected to the base portion and extending upwardly therefrom. In addition, an arm-supporting portion is connected to the front leg portion and curves rearwardly toward the back-supporting portion, and a seat-receiving portion, situated adjacent to the other end of said elongated member, is connected to the arm-supporting portion and curves downwardly therefrom and from the back-supporting portion, and also extends forwardly toward the front leg portion. A back means is positioned between the aforesaid back-supporting portions of the side frames and is secured thereto, and a seat means is positioned between the seat-receiving portions of the side frames and is secured thereto. Gibilterra 3,815,955 teaches, by preference, the utility of a tubular construction. However, it does not teach a tubular sleeve-like construction having a weldable insert for purposes of joining a series of complementary members as contemplated by the present application. Eberle U.S. Pat. No. 3,876,250 generally teaches a knockdown chair having side frame members of tubular construction adapted to flex in a manner such as to allow resiliently restrained downward movement of the seat. The knockdown chair provides a removable seat and/or back and depends for its structure and rigidity on those points of assembly. In view of such the present invention is also distinguishable over Eberle U.S. Pat. No. 3,876,250.

Holmes U.S. Pat. No. 2,625,205 is a patent which expired in 1970 and which relates to a chair comprising a frame assembled of tubular material. As best seen at FIG. 4 and further disclosed at page 2 of the embodiment, the patent teaches an embodiment comprising a joint connecting a series of complementary members. This joint comprises a short, solid, round rod 7 having an outer diameter to snugly fit in the tubular material. One end of this rod 7 is permanently fastened into the end of the U-shaped connecting member 5 and the other end telescoped into the end of the section 1. To prevent any separation of the rod from the end of section 1, a screw 8 is provided which extends through an opening in said section 1 and is screwed into a threaded hole in rod 7.

Holmes U.S. Pat. No. 2,625,205, however, differs in its means, method and function determined structure from the present invention. Holmes U.S. Pat. No. 2,625,205 fails to teach an assembly for chair having tubular studs welded to side frames of tubular construction to receive the back and front stretcher members by telescoping engagement and set screws for ease in plating and assembly as contemplated by the present invention.

SUMMARY OF THE INVENTION

The object of this invention is to provide a frame assembly for articles of furniture such as chairs which is composed of complimentary tubular end frames with crimped tubular support studs projecting laterally therefrom into the ends of tubular stretchers abutting the frames and hiding the studs.

The overall object is achieved by a novel chair frame design and the method of its assembly which allows several of said disassembled frame components to be plated simultaneously on a conventional production line. Each of said frame components is identical in every respect with the exception of the location of a support stud secured thereon for assembling the frame. The location of the studs dictates whether said frame components are a left or right members. A pair of studs are secured by means of a permanent weld to each of said frame components in a front-back orientation. Another pair of studs are similarly secured to a complementary component in a mirror image fashion having the same orientation for assembling both of said left and right components by means of a connecting stretcher which extends therebetween and set screws.

BRIEF DESCRIPTION OF THE DRAWINGS

FIG. 1 is a perspective view depicting the assembled chair in accordance with the principles of the invention;

FIG. 2 is an exploded view of a chair depicting the numerous elements and their relationship for assembly in accordance with the principles of the invention;

FIG. 3 is a partial cross-sectional view depicting the means for mounting a seating portion in accordance with the invention;

FIG. 4 is a diagrammatic view depicting the stretcher members receiving the mating studs in accordance with the principles of the invention;

FIG. 5 is a partial cross-sectional view depicting the interface of the mechanically crimped stud telescoped into connecting stretcher member and a set screw in accordance with the principles of the invention.

DESCRIPTION OF THE PREFERRED EMBODIMENT

Figure 6:
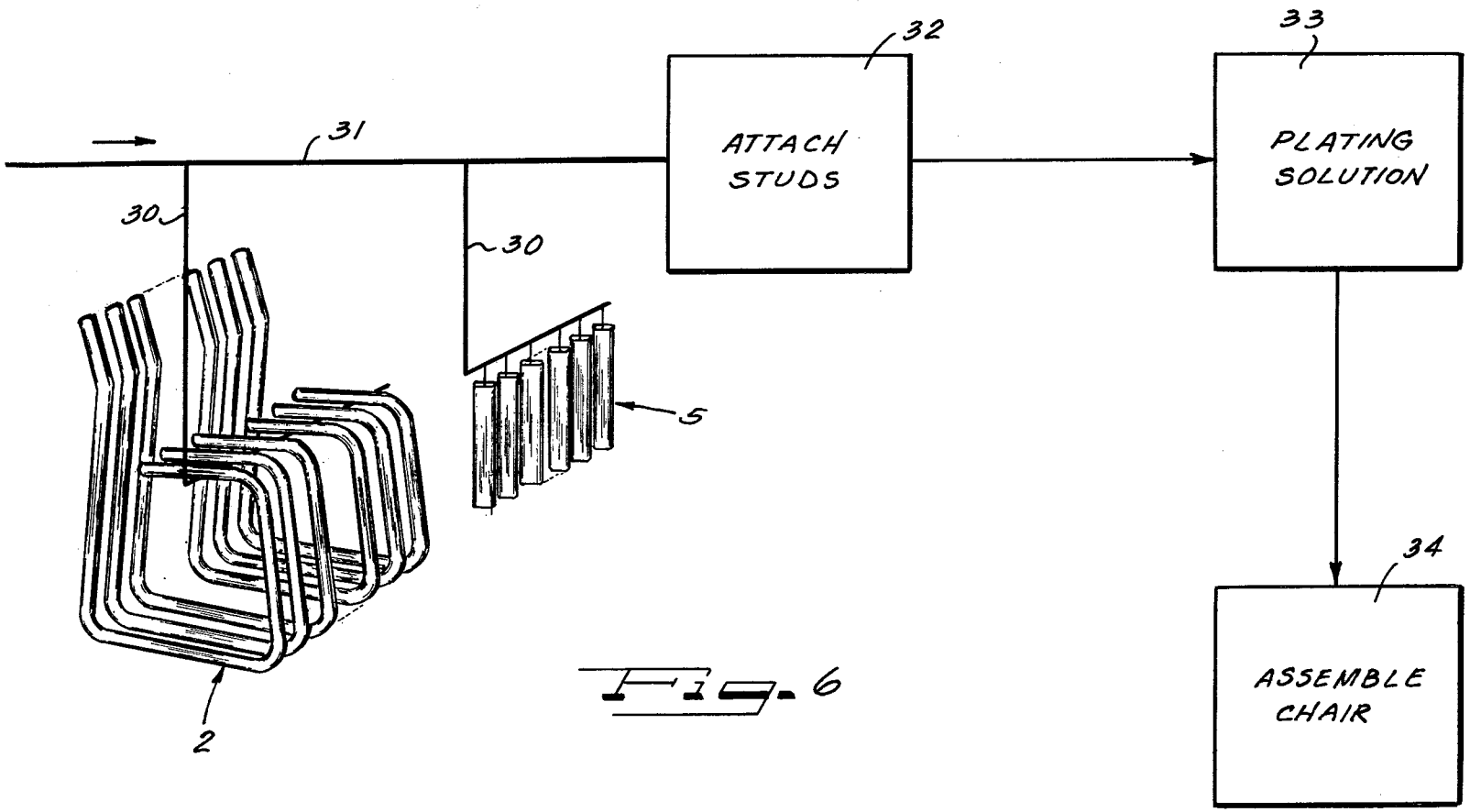
FIG. 6 is a diagrammatic view depicting the assembly line for said chair in accordance with the principles of the invention.

A chair frame assembly 1 generally comprising a tubular frame base 2, a seating portion 3 and a back rest portion 4 is shown at FIG. 1. The base 1 preferentially comprises an annular cross-sectional profile as best seen at FIG. 3. A pair of connecting stretcher members 5, disclosed in a front and back predetermined orientation *5a, 5b* respectively extend from one side to the other of said chair assembly 1.

A pair of support studs *6a, 6b* as best seen at FIG. 2 are secured to an inside face of a right frame base member *2a* in a front-back orientation. A complementary pair of support studs 7 a, *7b* are secured on an inside face of a left frame base member *2b*. Except for this mirror image orientation of said studs, said left and right frame members are identical. Said complementary support studs *6a, 7a* are each secured at substantially identical vertical and horizontal coordinates on their respective base members *2a, 2b*. The complementary support studs *6b, 7b* are also secured at substantially identical coordinates. This predetermined orientation allows easy and efficient connecting points for said stretcher members *5a, 5b* respectively.

The above disclosed invention lends itself to an easy and efficient means for the assembly of each of the individual components. As best seen at FIG. 2, the chair is assembled by connecting said base members *2a* and *2b* by means of said stretcher members *5a, 5b* and seat and back portions 3, 4 respectively.

The support studs *6a, 6b, 7a, 7b* each comprise a short segment of oval tubing of same stock as that which is utilized for the main frame base members *2a, 2b* and stretcher members *5a, 5b*. At one end 20 each of said studs are welded to the respective base members. At the other end, as best seen at FIG. 5, said studs are mechanically crimped bringing their front and rear sides together and having their top and bottom ends in their original arcuate shapes to offer a telescoping joint as a connecting means for snugly receiving said respective stretcher members. The stretcher members *5a, 5b* each comprise a straight oval tubing segment of annular cross section opened at each end.

Once mounted, said stretcher members are permanently secured thus providing overall stability for the assembled chair.

The invention as described in detail above further lends itself to efficient and inexpensive plating operation. Because each of said base members 2 are identical, no problems are thus encountered in the selection of said components during the production line process. Because only disassembled base members are moved along the production line, large numbers of support members may be moved simultaneously and randomly, increasing production efficiency. In operation, as best seen at FIG. 6, a plurality of said disassembled identical base members 2 are randomly arranged on each of overhead article carriers 30. A conveyor system 31 moves said base members to a designated work area 32 where a pair of studs are secured on each base member in a predetermined front back and side orientation. Said base members are then returned randomly to the stream of production and are further subjected to a plating process as indicated at station 33, still in random fashion. The connecting stretcher members are similarly plated. Once said components are plated, the chair is permanently assembled at station 34 by interfacing a pair of said complementary frame base members *2a, 2b* by means of said stretcher members, said seat members by means of a flanging element 9 depending from each of said frame base members and mated with said seat portion by means of a set screw 10, and said back support member, as best seen at FIG. 2 and 3. As best seen at FIG. 4, each of said complementary studs on the respective base members *2a, 2b* are telescoped into the respective receiving ends of said stretcher members. Each joint is then welded and further secured by means of set screws 8 mounted on the back side of said stretcher member and threaded through both abutting walls of the crimped stud *6a*, as best seen at FIG. 5, for a permanent connection. The front abutting wall is crimped rearwardly more than the back wall is crimped forwardly so that the screw 8 can project through both walls without piercing the front wall of the stretcher *5a*.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention. It is the intention therefore, to be limited only as indicated by the following claims.

I claim:

1. A chair frame which comprises a pair of tubular end frames each formed from a single piece of bent metal tubing of generally C shape with a bottom horizontal front to rear portion, an upstanding rearwardly sloping front leg portion at the front end of the bottom portion, a rearwardly extending horizontal seat support portion at the upper end of said front leg portion terminating in a free end, a forwardly sloping upstanding rear leg portion at the rear end of the horizontal bottom portion projecting above the free end of said horizontal seat supporting portion and inclined rearwardly at its top end to form a back support portion, tubular studs welded to said front and rear leg portions of each end frame and projecting laterally therefrom, the studs on one end frame being in mirror image relation with the studs on the other end frame, said tubular studs being crimped into a flattened configuration with front and rear side walls abutted together between the arcuate top and bottom portions of the tubes, front and rear tubular stretchers between said end frames having hollow ends telescoped over the respective crimped studs on the front and rear leg portions of said frame in snug engagement with the arcuate top and bottom portions of the studs and abutted against the inner faces of said leg portions, screws extending through the back sides of said tubular stretchers threaded into both of the abutted side walls of said crimped studs, said rearwardly extending horizontal portions on the upper ends of the front legs of each end frame having flange members projecting in the same directions as said studs on the frame members, a seat secured on said flanges spanning the space between the end frames, and a back member mounted on the rearwardly inclined portions of the upstanding rear legs of said end frames in spaced relation above said seat member.

2. A chair comprising a pair of laterally spaced bent tube end frames having inwardly projecting tubular studs welded thereto with flattened crimped portions, tubular stretcher members having hollow ends telescoped over said studs and bottomed against said end frame members, fasteners projecting from said stretcher members threaded into two side walls of the crimped studs, said end frames and stretcher members forming a rigid chair frame with the ends of the stretcher members abutting the end frames around the studs and covering the weld zone securing the studs to the end frames.

3. A chair frame comprising a pair of bent tube end frames having upright leg portions, back portions, and seat portions, studs welded to the inner faces of the leg portions at a level under the seat portions, hollow tubular stretcher members having end portions telescoped over said studs and abutted against the inner faces of said leg portions around the weld areas connecting the studs to the leg portions, an electroplate surface on said end frames, said studs, and said stretcher members, said tubular studs being crimped to slidably fit in said stretcher members, and fasteners projecting through said stretcher members threaded through two walls of the crimped portions of the studs.

4. The chair of claim 1 including an electroplate finish surface layer covering said end frames, said studs, and said stretcher members.

5. The chair of claim 1 wherein the tubular stretcher members have an oval cross section with a vertical major axis and the crimped portions of the studs have a conforming configuration slidably fitting into the ends of said stretcher members.

6. The chair frame of claim 2 wherein the tubes forming the studs and the stretcher members have an oval cross section with the major axes thereof in upright planes.

7. The chair frame of claim 2 wherein each end frame is a single tube bent to form a seat support, a front leg, a horizontal bottom, a rear leg and an upright back support.

8. The chair frame of claim 2 wherein the tubular studs each have an oval configuration with a vertical major axes and each stretcher member has a conforming oval configuration snugly engaging the stud.

9. The chair frame of claim 3 wherein the crimped studs have the side walls abutted together close to the rear sides of the stretcher members to allow the fasteners to project through the abutted side walls without piercing the stretcher members.

10. The chair frame of claim 3 wherein the fasteners are screws threaded through said two walls.

11. The chair frame of claim 3 wherein the bent tubes of the end frames have oval cross sections.

* * * * *